US008410879B2

(12) United States Patent
Lesk

(10) Patent No.: US 8,410,879 B2
(45) Date of Patent: Apr. 2, 2013

(54) SOLENOID

(75) Inventor: Hans-Kersten J. Lesk, Immenstadt (DE)

(73) Assignee: SVM Schultz Verwaltungs-GmbH & Co. KG, Memmingen (DE)

( * ) Notice: Subject to any disclaimer, the term of this patent is extended or adjusted under 35 U.S.C. 154(b) by 175 days.

(21) Appl. No.: 12/923,381

(22) Filed: Sep. 17, 2010

(65) Prior Publication Data

US 2011/0063056 A1 Mar. 17, 2011

(30) Foreign Application Priority Data

Sep. 17, 2009 (DE) ..... 10 2009 041 604

(51) Int. Cl.
*H01F 3/00* (2006.01)
*H01F 7/08* (2006.01)

(52) U.S. Cl. ..... 335/281; 335/255; 335/262; 335/278

(58) Field of Classification Search ..... 335/281, 335/250–251, 255, 262, 271, 278
See application file for complete search history.

(56) References Cited

U.S. PATENT DOCUMENTS

| | | | | | |
|---|---|---|---|---|---|
| 1,226,748 | A * | 5/1917 | Burnham | 335/247 |
| 2,931,617 | A * | 4/1960 | Jamieson | 251/54 |
| 4,790,345 | A * | 12/1988 | Kolchinsky | 137/269 |
| 5,208,570 | A * | 5/1993 | Nippert | 335/261 |
| 5,875,922 | A * | 3/1999 | Chastine et al. | 222/1 |
| 5,915,591 | A * | 6/1999 | Erickson et al. | 222/1 |
| 6,257,445 | B1 * | 7/2001 | Means et al. | 222/1 |
| 6,628,186 | B1 * | 9/2003 | Wolfges | 335/220 |
| 7,350,763 | B2 * | 4/2008 | Hofling | 251/129.15 |
| 7,975,982 | B2 * | 7/2011 | Chan et al. | 251/129.15 |
| 2008/0180200 | A1 * | 7/2008 | Gamble | 335/234 |

* cited by examiner

*Primary Examiner* — Mohamad Musleh
(74) *Attorney, Agent, or Firm* — Jacobson Holman PLLC

(57) ABSTRACT

The invention refers to a solenoid with a magnet body connected with a tube pipe, wherein means for fastening the magnet body to the tube pipe are provided, and the means have at least one electrically conductive element, which is in contact, on the one hand, with the tube pipe, on the other hand, with the magnet body, for electric connection of tube pipe and magnet body.

13 Claims, 4 Drawing Sheets

Figure 1:
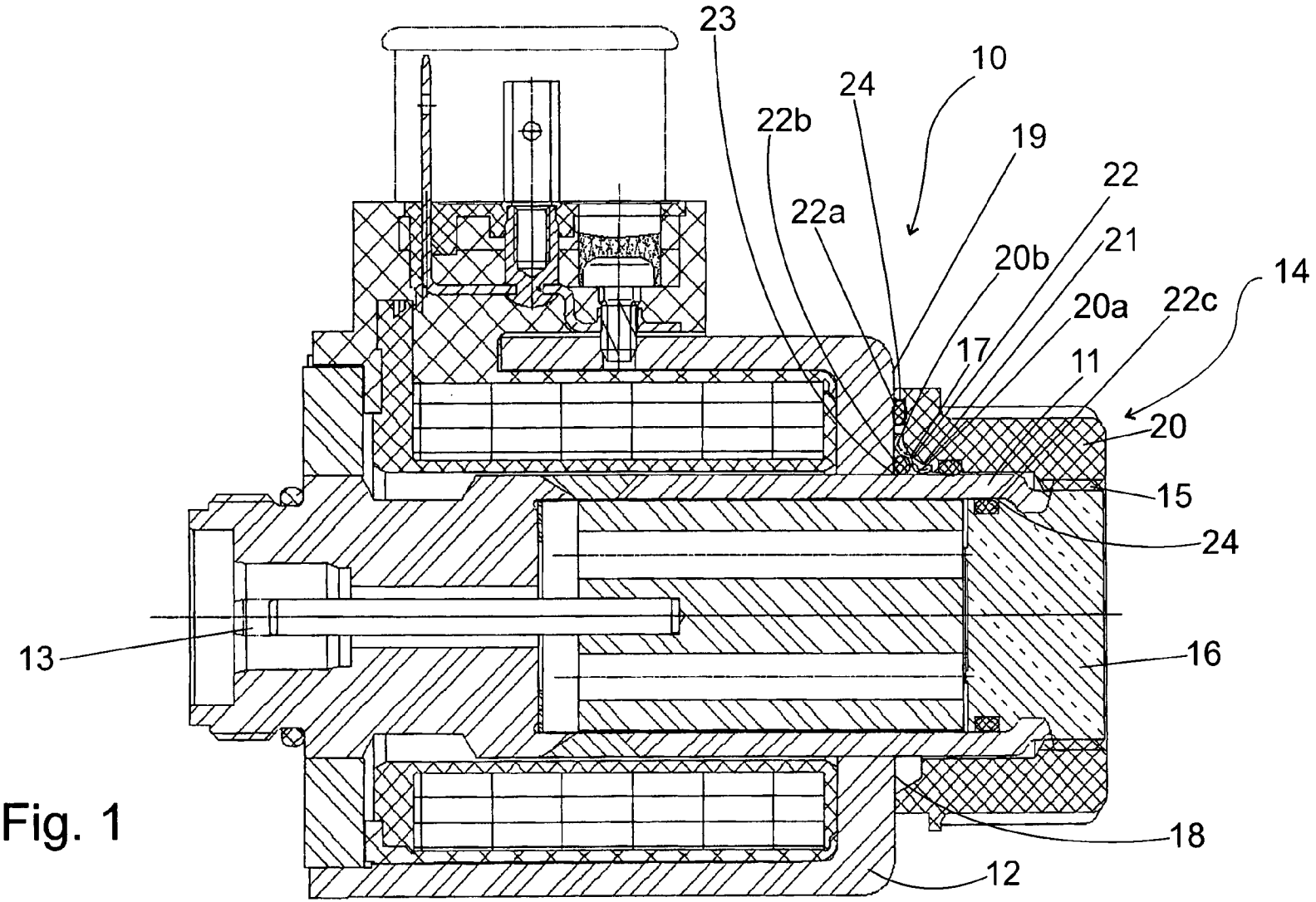

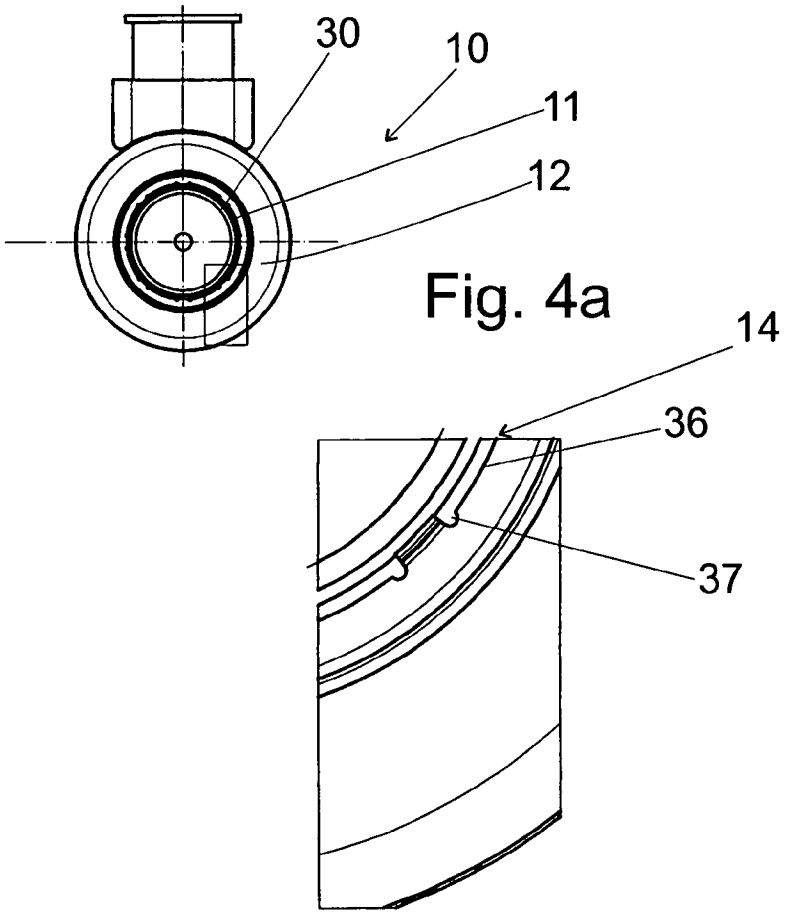
Fig. 4a
Fig. 4b
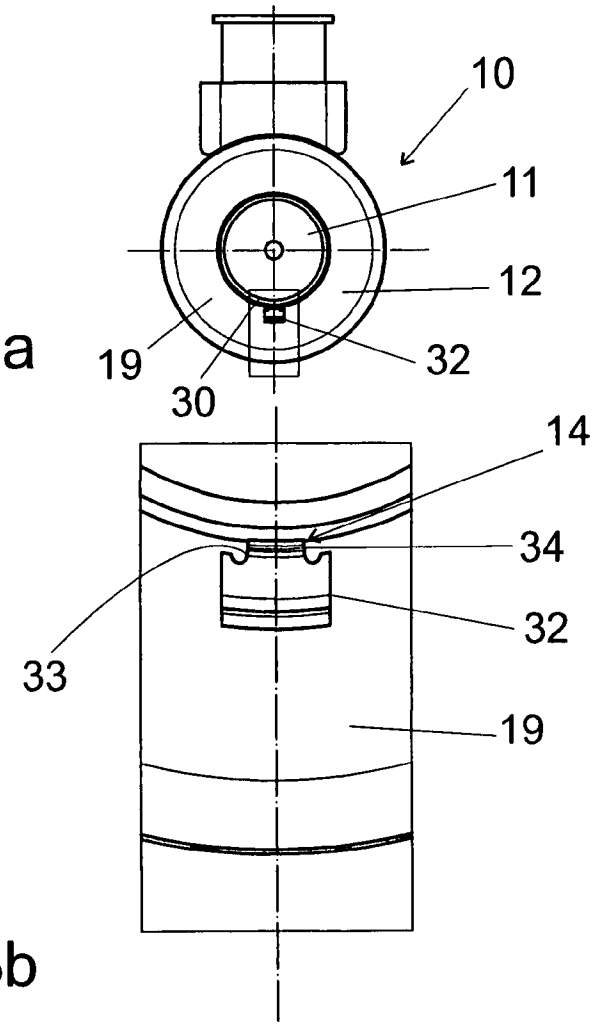
Fig. 3a
Fig. 3b

SOLENOID

This application has a priority of German no. 10 2009 041 604.8 filed Sep. 17, 2009, hereby incorporated by reference.

The invention refers to a solenoid with a magnet body connected to a tube pipe, wherein means for fastening the magnet body to the tube pipe are provided, and the means have an electrically conductive element contacting at least one, on the one hand, the tube pipe, on the other hand, the magnet body for electrically connecting the tube pipe and the magnet body.

BACKGROUND OF THE INVENTION

Solenoids with a tube pipe and a magnet body arranged on it are known. For connecting magnet body and tube pipe the magnet body is slipped on, slid on or pressed on the tube pipe, and thus more or less permanently connected with the tube pipe. The tube pipe serves here as guide of a magnet armature which can be moved by loading with current.

As a rule solenoids have a protective conductor which is arranged in such a way that an electric connection is produced between the metal parts of the solenoid and the ground. It is, in particular, important here that the protective conductor contacts all metallic parts of the solenoid. In conventional solenoids having a magnet body slid or pressed on the tube pipe after a long use which not seldom is accompanied by vibrations, a separation of the connection between the tube pipe and the magnet body occurs. With this separation often also the protective conduction is interrupted so that the grounding of the solenoid is no more sufficient. In addition to that, caused by the fact that the magnet body is separated from the tube pipe, also function error of the solenoid may occur which is not desired in permanent operation, and leads to standstill times as well as expenses for repair and thus costs.

BRIEF SUMMARY OF THE INVENTION

It is an object of the present invention to provide a solenoid with a tube pipe as guide for a magnet armature and a magnet body connected with a tube pipe, having a reliable connection between tube pipe and magnet body.

According to the invention this problem is solved by providing a solenoid comprising a tube pipe as guide for a magnet armature and a magnet body. In the solenoid according to the invention, as already known from the state of the art, the magnet body is connected with the tube pipe. In order to create a reliable connection between the tube pipe and the magnet body, the solenoid according to the invention is characterized in that at least a means is provided for fastening the magnet body to the tube pipe. Via this means a permanent connection between tube pipe and magnet body can be produced. In order to guarantee here also that the solenoid is grounded, because of the non-interrupted electric contact of magnet body and tube pipe, and here currents can be derived here, it is provided that the means has at least one electrically conductive element for the electric connection of tube pipe and magnet body. The electrically conductive element contacts here, on the one hand, the tube pipe, and, on the other hand, the magnet body. The electrically conductive element contacts here the metallic surfaces of the tube pipe and magnet body, respectively, so that current may flow here unhindered.

The means for fastening magnet body and tube pipe or for fixing the magnet body at the tube pipe which is used in the solenoid according to the invention, can be realized as nut, clamp, split-in, shackle, plug-type connector, clip, clamping ring or in another way which secures a safe and reliable, and, first of all, permanent connection between magnet body and tube pipe. If the means is a nut, it is, after sliding or slipping on or jamming the magnet body with the tube pipe, screwed on the tube pipe, which has conveniently a corresponding thread. Alternatively there is also the possibility that the magnet body has a thread which is, for example, put on or integrated which engages with a corresponding counter thread of the nut. There is also the possibility that a thread is attached to the nut that thus projects over the nut, and protrudes from a surface of the nut, and is screwed in a recess in the magnet body, which encircles, for example, the tube pipe. Of course, there is also the possibility that two threads are provided altogether, one radial arranged thread on the tube pipe and one axially arranged thread in the magnet body, and the nut has corresponding counter threads, and thus can be connected or screwed together with the tube pipe as well as the magnet body.

A simpler design of the means for fastening is the design as clamp which is clamped or put on the tube pipe or the magnet body after assembling tube pipe and magnet body in one of the ways already described above. Here also suitable shoulders, grooves or flanges can be provided on the tube pipe and/or magnet body which are engaged with the clamp. Via the corresponding holding means for the clamp also a fixing of the direction of arrangement or attaching of the clamp and the position of the clamp, respectively, can be determined. A particularly simple connection between tube pipe and magnet body can also be reached by the use of a split-in. This split-in is inserted in a recess or opening provided either in the tube pipe or in the magnet body or in both parts of the solenoid, and after that in the way of a split-in connection is fixed by bending or deforming the split-in. The means for fastening can also be designed as an additional castle nut interacting with a split-in, the possibility being here that either the nut or the split-in or both are electrically conductive, and guarantee an electric connection of tube pipe and magnet body.

Beside the already mentioned means for fastening the means can also be designed as shackle or set of shackles which are arranged, for example, swiveling on the tube pipe, and engage in a projection or another suitable receiver on the magnet body. Vice versa there is, of course, also the possibility that the shackles themselves are arranged swiveling on the magnet body and engage in holding means on the tube pipe. Of course, the shackle can also be designed such that it covers the magnet body as well as the tube pipe, and is clamped with both elements, here a fixing of the shackle or the shackle ends being carried out preferably at the magnet body and the tube pipe being bordered, encompassed or embraced. The means can also be designed as plug-type connector or connection. Here a clamping connection is provided additionally to the jamming or bracing of the tube pipe with the magnet body. The plug-type connector has for that purpose corresponding recesses or projections. The connection or fastening of the magnet body to the tube pipe can also be carried out with a clip. This is a combination of the features of a clamp and of a shackle, and is, on the one hand, clamped with the tube pipe or the magnet body, and encircles, on the other hand, the tube pipe or the magnet body, in order to secure here a reliable connection between the two parts of the solenoid. Another possibility for carrying out the means for fastening is to design it as clamping ring. For that the tube pipe or the magnet body has a ring groove which is designed, for example, circulating in which the clamping ring is pressed or put. There is also the possibility of the tube pipe having a groove-like impression in the way of a bead in which the clamping ring or parts of the clamping engage or with which the clamping ring is clamped or jammed. The same or a similar arrangement can, of course, be also arranged on the magnet body. The connection between tube pipe and magnet body is then carried out as follows: First of all, the tube pipe is manufactured, and here, if necessary, suitable impressions or projections are arranged. After that, the magnet body is put or slid on the tube pipe, and here fixed, for example, in the press fit. After that, a permanent fixing of the magnet body on the tube pipe is carried out, and thus the assembly of the solenoid by arranging the means for fastening. If here, for example, a clamping ring is provided the clamping ring is, first of all, slid on the tube pipe until the area of the clamping ring reaches the ring groove or bead-like impression provided on the tube pipe or the magnet body. By locking-in or snapping-in of the clamping ring in this impression this is fixed on the tube pipe or the magnet body. After that, then pressing or jamming together of the clamping ring or a part of it is carried out so that this is in contact without allowance with the magnet body or the tube pipe, and connects permanently, reliably and stably both elements of the solenoid. The mentioned means for fastening all allow a reliable connection between the tube pipe and the magnet body, and can additionally be arranged and manufactured particularly simply and thus economically. In order to secure an electric contact of tube pipe with magnet body, it is seen as advantageously if the means for fastening is designed as an electrically conductive element, or if the electrically conductive element is connected with or integrated in the means for fastening. A connection to or integration of the electrically conductive element in the means can here be designed fixedly or releasable. Of course, there is also the possibility that a fixed connection between electrically conductive element and means for fastening is produced only by or during putting on, slipping on, screwing on or clamping on the means for fastening on tube pipe or magnet body. Furthermore, the electrically conductive elements or the electrically conductive element can be integrated already before in the means for fastening, and an electrically conductive activation of the element is carried out only during or after screwing on, clamping on, putting on, sliding on or other arrangement of the means on the tube pipe or the magnet body.

In this connection it is seen as favourably if the electrically conductive element is designed as washer. Here, for example, embodiments as flat spring, wave washer or flap washer are possible, which, on the one hand, can guarantee a securing of the means for fastening, and, on the other hand, a permanent and particularly stable electric contact or connection of the magnet elements. The flat spring as an embodiment of the washer which can be used as electrically conductive element, is here deformed by arranging, clamping on, screwing on or sliding on the means for fastening, which can be manufactured in any way, and here, on the one hand, put in contact and pressed on the tube pipe and, on the other hand, the magnet body, so that here an electric contact exists. The use of a wave washer or flap washer works according to a similar principle, wherein with the latter already deformed areas are provided which can be brought into contact, on the one hand, with the tube pipe, and, on the other hand, with the magnet body, in order to improve here the electric connection of these elements. Besides the design of the electrically conductive element as washer, there is also the possibility to design it as ring which is slipped over the tube pipe and brought in contact with the magnet body. Here also only by means of the ring already a fixing of the magnet body on the tube pipe can be carried out by using the ring as means for fastening, on the one hand, and as electrically conductive element, on the other hand. The ring then is connected permanently either with the tube pipe or the magnet body, for example, is put in a suitable recess, groove or flute on the tube pipe or magnet body, and is then jammed or pressed together with either magnet body or tube pipe. This guarantees also that the electrically conductive element remains limitedly flexibly, and thus can react to the movements of the magnet body on the tube pipe or shiftings of the tube pipe in the magnet body without interrupting the electric contact between the parts. For a further improvement of the electric contact here also the ring can be designed as annular gear or in the way of a tooth lock washer. During attaching, putting on, slipping on, screwing on or clamping on of the means for fastening the ring then damages the surface of the tube pipe or the magnet body or both parts, as the ring or the washer carries particular tooth-like projections for this purpose. By damaging the surface the contact surface between the electrically conductive element and tube pipe or magnet body is created or enlarged, and the electric contact is produced or improved by that.

If a releasable or fixed arrangement of the electrically conductive element is provided in the means for fastening in or on the tube pipe and/or in or on the magnet body, it has been found to be particularly advantageous if here an in particular groove-like recess is provided serving for engaging the electrically conductive element. This groove-like recess can be provided already during manufacturing the tube pipe, the magnet body or the means for fastening in it, or can be later cut in, integrated, milled or in any other way be attached. Thus, there is, for example, the possibility of forming the means for fastening of a synthetic material. Here already during manufacturing, which is done, for example, by injection moulding, a suitable recess can be integrated in the work piece or planned or moulded in. In the tube pipe, which may also be formed of a synthetic material, the recess or the impression or the groove can be integrated in the work piece also already during manufacturing. However, there is, of course, here the possibility of integrating the recess later.

A preferred embodiment of the invention provides that the electrically conductive element is arranged releasable or fixedly on or in the means for fastening and the tube pipe and the magnet body, respectively. This means, that the electrically conductive element is provided on one of the mentioned parts of the solenoid, and an electric connection is carried out after putting on, attaching to, screwing on, slipping on or other connecting of tube pipe and magnet body and/or the fixing of the means for fastening. In order to be able to carry out here a releasable or fixed connection of electrically conductive element and means for fastening or tube pipe or magnet body, an arrangement, in particular by gluing, melting, soldering, welding or the positive locking in or on the element is advisable. Another alternative is jamming in, that means producing a mechanic connection. If the means for fastening, the magnet body or the tube pipe is made of an electrically non-conductive material or this has areas which are designed electrically non-conductive, a preferred embodiment of the invention provides that the electrically conductive element is provided integrated in the means for fastening, the magnet body or the tube pipe or in their areas, so that here nevertheless a sufficient and reliable as well as safe electric contact can occur. There is here for integrating the electrically conductive element the possibility of injecting it, for example, during the manufacturing process of the means for fastening, the magnet body or the tube pipe with a work piece blank. If here a casting mould is used, the electrically conductive element can, of course, also be casted-in with the casting compound, in order to be integrated here in the means for fastening, the magnet body or the tube pipe. There is, of course, also the possibility of arranging the electrically conductive element later by melting it in the means for fastening, the magnet body or the tube pipe.

Melting in can be done here in a particularly simple manner in that the electrically conductive element is loaded with current and thus is heated. By means of that at the same time a functional control of the electrically conductive element can be carried out. As already explained before, the electrically conductive element can be designed as deformable washer or deformable ring. Besides, there is also the possibility of designing the electrically conductive element in another way and of designing it here also deforming or twisting. Contacting magnet body or tube pipe is then being carried out after deforming or twisting the electrically conductive element. During deforming or twisting the electrically conductive element also engaging of the electrically conductive element in the magnet body and/or the tube pipe can occur, so that here either only by the engaging an electric contact is formed with an electric connection, or by means of engaging the already existing electric contact is improved and stabilized further. The production of an electric connection as well as the engaging of the electrically conductive element in the magnet body and/or the tube pipe can be provided here before, during or after deforming or twisting. This means that the electrically conductive element is, first of all, put on or attached to loosely, that means in the running fit or sliding seat on the tube pipe or the magnet body, and then, during the deforming or twisting process, a fixing of the electrically conductive element is carried out. During deforming or twisting the electrically conductive element then an electric contact is produced or created or it is improved and stabilized.

The electrically conductive element is, in a preferred embodiment of the invention, designed in such a way that a radial or axial contact of the magnet body occurs, wherein also, on the other hand, an axial and/or radial contact of the tube pipe occurs. Of course, there is also the possibility that the electrically conductive element contacts one of the parts, that is the magnet body or the tube pipe, radial, and the second part, that is the magnet body or the tube pipe axially, on the other hand. An axial and radial contact can be reached, for example, by providing a circulating ring groove there, by engaging a part area of the electrically conductive element and another area of the electrically conductive element then being in contact in axial direction with the tube pipe parallel with the surface or parallel with the circumference. With reference to the magnet body there is the possibility that an area of the electrically conductive element is supported on a first surface of the magnet body and extends radial in this surface, while a second area is arranged co-axial to the magnet body and is in contact axially with another surface of the magnet body.

According to the invention it is also provided that the electrically conductive element designed in particular as washer, ring or clamp, or the means for fastening has cutting edges, edges or edges of cut, and thus a contacting surface on the magnet body and the tube pipe is created during putting in, attaching, putting on, clamping on, twisting or jamming on its own.

It is provided here that the cutting edges engage in the material of the magnet body and/or the tube pipe by edges of cut, and remove here a surface layer, and are fixed permanently in the material of the magnet body or the tube pipe. The electrically conductive element is here, for example, interlocked with the magnet body and the tube pipe or it is clawed in it and tears open areas of the surface of the tube pipe and/or magnet body so that a naked contact surface is generated or enlarged, and the permanent conductivity is secured.

For the sake of saving material during manufacturing the electrically conductive element this can also be manufactured, on the one hand, as washer or ring, and the thickness of the ring or the washer can be reduced as far as possible, so that it is only a few millimeters to tenths of millimeters. The washer or the ring can also be designed as film. In another embodiment radial tweak-outs are arranged on the washer or ring, on the inner or outer circumference. These tweak-outs then are spaces of the washer or ring without material. Between the tweak-outs rests of the washer or ring body remain so that the washer or the ring is designed eventually in the way of an annular gear with projections on the outer and inner circumference. In order to secure now a reliable and stable electric connection between the tube pipe and the magnet body, it can be provided here that the remaining rests of the ring body are deformed, in particular bent, alternating in the direction of the tube pipe or the magnet body or radial or axially to it, and are in contact, on the one hand, with the tube pipe and, on the other hand, with the magnet body.

As the electrically conductive element is designed permanently electrified there is the possibility that corrosion occurs. In order to prevent that, a preferred embodiment of the solenoid according to the invention provides that at least one seal is provided which encloses the electrically conductive element.

The electrically conductive element can be arranged here, for example, between at least two sealing elements arranged in axial direction of the tube pipe. During assembly or forming of the solenoid, first of all, the magnet body is slid or slipped on the tube pipe, and on this already fixed in running fit or sliding seat. Next a first seal, for example a conical nipple or a sealing lip or a sealing washer is slid on the tube pipe, after that then putting on, sliding on, jamming on, clamping on or screwing on of the electrically conductive element is done. After that a second seal, this may be again designed as washer, ring, lip or in another suitably seeming way, is slid on the tube pipe so that the electrically conductive element is arranged between two sealing elements arranged in axial direction of the tube pipe. Alternatively or additionally there is, of course, also the possibility that the electrically conductive element is formed or injected in the seal, that means it is essentially integrated in the seal. Here a complete enclosing of the electrically conductive element by the material of the seal or by the seal itself can be provided. If this is the case, the electrically conductive element penetrates the seal at least in sections in radial and axial direction, and is in contact with the tube pipe and the magnet body. Penetrating or breaking through the seal is preferably carried out only during deforming or twisting the electrically conductive element. It is provided here that the electrically conductive element is surrounded completely by sealing material, and thus, for example, has, when not built in, the shape and look of a conical nipple or a sealing washer. After putting the element on the tube pipe or arranging in the means for fastening and after fixing in the solenoid according to the invention, during fixing the sealing material it is penetrated by the electrically conductive element arranged in the interior at least in sections radial as well as axially, and thus a contact is created of the tube pipe and the magnet body. In order to carry out here a satisfying break through, the electrically conductive element has conveniently suitable cutting edges, edges or projections which are able to penetrate the elastic material of the seal. There is also the possibility that, for example, when a ring or a washer is used and on the surfaces of the washer or the ring sealing material is glued on, sprayed on, welded on or in any other is arranged, and thus the electrically conductive element can be arranged in the solenoid provided already with seals. There is also the possibility here that the electrically conductive element breaks through the seal only in some areas, and thus only an electric contact via the electrically conductive element is carried out only in some areas.

A preferred embodiment of the electrically conductive element which can be put in the solenoid according to the invention provides that the electrically conductive element has engaging means, for example here cutting edges, projecting edges or edges of cut carrying out a damaging of the surface of the magnet body and/or the tube pipe in order to create or improve here an electric contact. Because of the engagement in the surface of the magnet body or the tube pipe, however, a corrosion resistant oxide layer which forms when the surface is suitably treated, is damaged or removed so that here in particular on the engaging spots or contact surfaces of the cutting edges, edges or edges of cut points of corrosion form.

In order to reach a practically air-sealed closing of the electrically conductive element towards the surrounding atmosphere, in a preferred embodiment of the solenoid according to the invention the arrangement of seals in the means for fastening is provided, the seals arranged here being arranged distanced from the electrically conductive element. A first seal is provided here axially in contact with the tube pipe, and a second seal sealing radial on the magnet body.

Between these two seals, which can be, for example, put in or attached to, for example injected or integrated, corresponding recesses or grooves in the means for fastening, the electrically conductive element is then positioned, and is protected by the seals, which can be designed, for example, as conical nipple, seal strip, seal mass or seal tape, against intruding moisture. The seals are arranged spaced from the electrically conductive element in the means for fastening, so that there is never a risk here of damaging the seals by the electrically conductive element which is designed partly sharp-edged.

Advantageously the seals which can be used with the solenoid according to the invention are designed as O-rings, seal tapes, sealing lips or sealing washers. If two seals—as already mentioned above—are arranged above and below the electrically conductive element, there is also the possibility that at least two seals form a contact space on the tube pipe or in the magnet body in which the electrically conductive element is arranged. The seals terminate then the contact space on two sides. The seals do not have to be arranged assigned to the electrically conductive element directly on the solenoid, that means on the tube pipe and/or the magnet body. It is important that the seals prevent moisture or air from getting in so that there is no corrosion of the electrically conductive element.

There is also the possibility that the electrically conductive element is designed as so-called conductive rubber. This conductive rubber then consists of rubber material filled or provided with carbon particles. The use of a conductive rubber has the advantage that here a permanent elastic connection can be carried out which can secure also a stable and permanent electric connection between tube pipe and magnet body even with vibrations occurring in solenoids. Additionally, the conductive rubber takes over a seal function for the connecting point or surface of tube pipe and magnet body.

It is also seen as advisable if an additional seal arranged directly on or in the electrically conductive element is provided. This seal can be used for fastening, connecting or clamping the electrically conductive element to the means for fastening and to seal it at the same time. This is done in that the seal element is deformed in a connection of electrically conductive element and means for fastening, and during this deforming a deforming of the electrically conductive element is carried out so that this is pressed in the means for fastening or is put in permanently and fixed. Here also, as in all other used seals, there is also the possibility of forming it completely or partly of conductive rubber.

The electrically conductive element is designed, in a preferred embodiment of the solenoid according to the invention, as a ground strap or in the way of a ground strap. The ground strap can have here a braiding formed by wire material, be formed by a metal strip or tape or of a plastic strip provided with metal. A first end of the ground strap is here provided for fixing on the tube pipe, while a second end of the ground strap contacts the magnet body. The strap body, that means the area connecting the two ends of the ground strap, is arranged on or in the means for fastening or fixed in it or integrated in it.

It has been proved to be favourable if the electrically conductive element is designed as an at least partly electrically conductive coating of the means for fastening. By coating it can be secured that a sufficiently large surface is provided for electric contact. Furthermore, the coating can then also remain stably on the means for fastening when this or these is/are deformed. If, for example, the means for fastening is designed as fastening nut, there is the possibility that here the thread of the nut or its complete surface is provided with an electrically conductive coating. During screwing the nut on the tube pipe or the magnet body then the electric contact is produced. Of course, there is also the possibility that the means for fastening is formed of an electrically conductive material and has a protective coating which is damaged or removed during arranging the means for fastening on the tube pipe and/or the magnet body, and an electric contact takes place only then. Besides, there is also the possibility that the means for fastening is formed, for example, of an electrically non-conductive basic material which is loaded with conductive material, in which, for example, conductive particles, such as metal particles or chips, for example graphite or carbon dust, have been mixed in. Via that then an electric conduction of the means for fastening is reached which is used later for the electric connection of tube pipe and magnet body.

The invention also provides a solenoid having a housing enclosing the tube pipe and the magnet body. In order to secure here a contact of the tube pipe and the magnet body, there is, on the one hand, the possibility of integrating the electrically conductive element in the housing, and carrying out a fixing of tube pipe, housing and magnet body through the means for fastening. During this fixing then the electric contact, or the connection of magnet body and tube pipe is produced. Furthermore, there is also the possibility of designing the electrically conductive element in such a way that an electric connection of housing, magnet body and tube pipe can take place via the electrically conductive element. Here the use of all before-mentioned embodiments of the electrically conductive element or means for fastening are possible, wherein only the housing will still be comprised or fixed or contacted by these parts of the solenoid.

The solenoid according to the invention is preferably suited for an operating voltage in the low-voltage range, that means between 12 V and 400 V. It is seen as favourable if a voltage between 12 V and 230 V, between 12 V and 48 V or between 12 V and 35 V is connected to the solenoid. There is, of course, the possibility of connecting also operating voltages which are higher or lower, that means in a range below 12 V or above 400 V to the solenoid. The electrically conductive element has then to be designed in such a way that these voltages can be received as well.

It is clear that the characteristics mentioned before and which will be described further on cannot only be considered, employed or used in the respectively mentioned combinations but also in other combinations.

BRIEF DESCRIPTION OF THE DIFFERENT VIEWS OF THE DRAWINGS

Figures 2A, 2B:
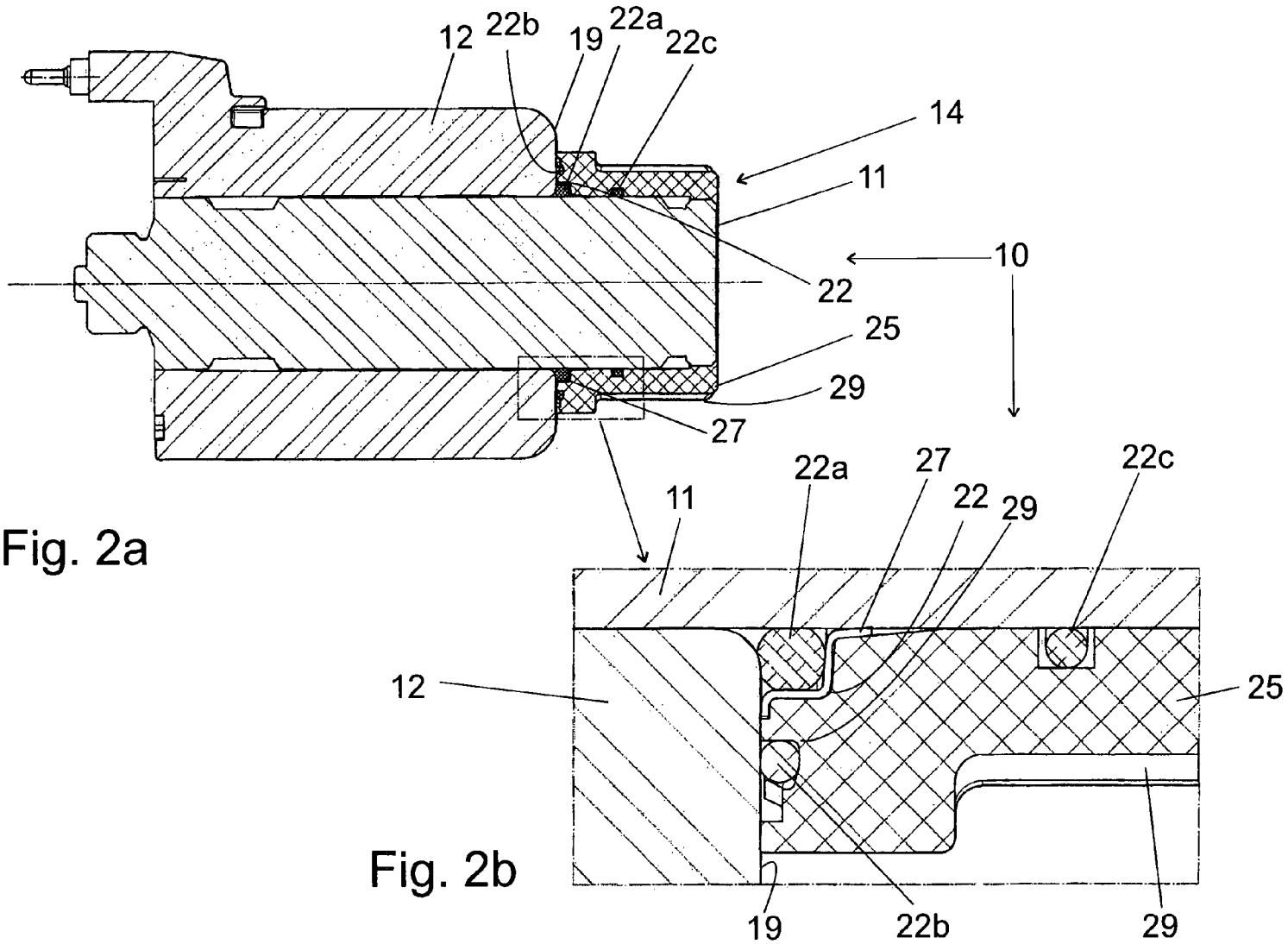

The invention will be described by means of embodiments with reference to the corresponding drawings. In the drawings:

FIG. 1 a schematic cross-section of a side view of a solenoid according to the invention;

FIG. 2*a* a schematic cross-section of another side view of a solenoid according to the invention;

FIG. 2*b* a detailed view of a cutout of the electrically conductive element in a built-in position on a solenoid;

FIG. 3*a* a top view of an embodiment of the solenoid according to the invention;

FIG. 3*b* a cutout view out of the top view of FIG. 3*a;*

FIG. 4*a* another top view of a preferred embodiment of the solenoid according to the invention;

FIG. 4*b* a cutout view out of the top view of FIG. 4*a*; and

Figure 5:
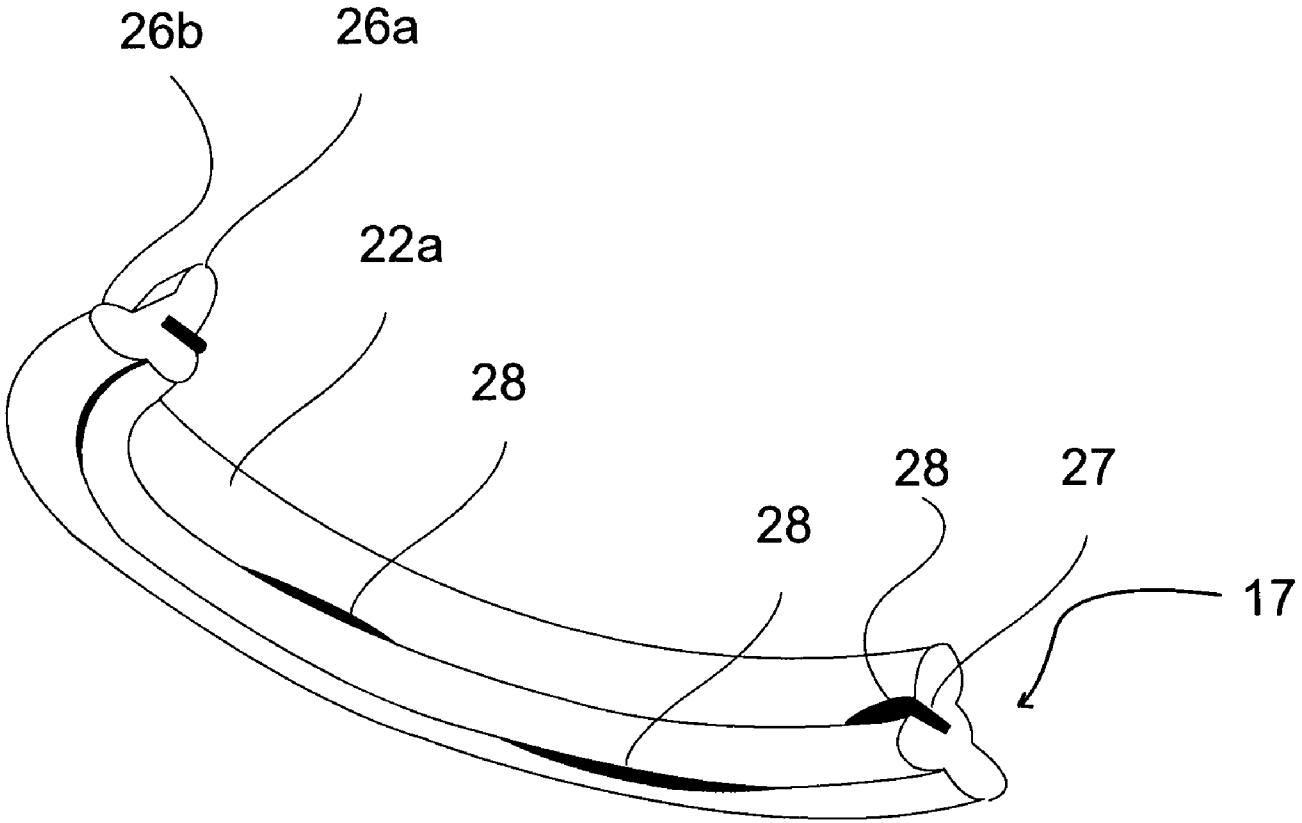

FIG. 5 a perspective sectional view of an electrically conductive element integrated in a seal.

DETAILED DESCRIPTION OF THE PREFERRED EMBODIMENT

FIG. 1 shows a solenoid 10 in cross section in a side view. In a cylindrical tube pipe 11 an armature 13 is arranged. Put on the tube pipe 11 there is the magnet body 12 having all parts of a solenoid 10 essentially for a solenoid, however, in connection with the present invention not described further. The magnet body 12 has been slipped on the tube pipe 11 in the embodiment of FIG. 1, and is held on it in sliding seat. The top end of the solenoid 10, on the right hand in FIG. 1, is a fastening nut 20 with an internal thread 15 which is screwed together with the magnet core 16 pressed together with the tube pipe 11. The fastening nut 20 serves as means 14 for fastening the magnet body 12 to the tube pipe 11. By means of this a permanent fixing of these two parts of the solenoid 10 is reached. This connection is improved by screwing the fastening nut 20 together with the magnet core 16, the fastening nut 20 pressing the magnet body 12 together with the tube pipe 11. The magnet body 12 is in electric connection with the tube pipe 11. Because of the fact that the magnet body 12 is only put on the tube pipe 11 in sliding seat, there is the possibility that these two parts of the solenoid 10 become loose from each other during operation which is accompanied, as experience shows, by vibrations. When the magnet body 12 is loosened from the tube pipe 11 also the electric connection existing between these two parts is interrupted, and the grounding of the solenoid 10 or the tube pipe 11 and the magnet body 12 cannot be guaranteed sufficiently anymore. In order to guarantee a permanent and reliable securing of the solenoid 10 by a stable and, first of all, a connection which can be interrupted only hardly or not at all between the tube pipe 11 and the magnet body 12, the solenoid 10 shown in FIG. 1 has an electrically conductive element 17, which is in contact, on the one hand, with the outer surface 18 of the tube pipe 11, and, on the other hand, with the surface 19 of the magnet body 12, and guarantees here an electric connection. The electrically conductive element 17 is in the example designed as partial ring enclosing the tube pipe 11 in several areas. In the cross section of the ring its structure becomes visible. This has a first arc 20*b* which causes a certain pre-tension of the electrically conductive element 17 with reference to the surface 19 of the magnet body. Orientated to the tube pipe 11 the ring has a second arc 20*a* which also causes here a pre-tension of the electrically conductive element 17. The partial ring, as which the electrically conductive element 17 is designed, has additionally a circulating groove 21 serving as receiver or set-in spot or surface for a seal ring 22*a*. The electrically conductive element 17 is, in the example, integrated in the fastening nut 20. Because of the pre-tension of the electrically conductive element 17 by the two arcs 20*a*, 20*b* this is, during screwing on the fastening nut 20 on the magnet core 16, connected with the tube pipe 11, on the one hand, and the magnet body 12, on the other hand, and after finishing screwing on the electrically conductive element 17 is then in a tensioned position so that here a permanent and reliable or stable electric connection of magnet body 12 and tube pipe 11 is realized. When the fastening nut 20 with integrated or put-in electrically conductive element 17 is produced, first of all, the electrically conductive element 17 is put in the fastening nut 20 having a special recess or a circulating ring-like groove or impression for that. After that the seal 22*a* is put on the electrically conductive element 17 and this is pre-deformed by that in the direction of the body of the fastening nut. During this deforming by the seal 22*a* the arcs 20*a* and 20*b* are curved so that they are distant from the impression or flute in the fastening nut 20, and are orientated in direction of the tube pipe 11, on the one hand, and the magnet body 12, on the other hand. The electrically conductive element 17 is in the embodiment not designed as completely circulating ring 27, but as partial ring encircling the tube pipe 11 only along an area of the circumference. Of course, there is also the possibility here of designing the electrically conductive element as a ring 27 encircling the tube pipe 11 completely or as washer. Besides, there is also the possibility of arranging in the fastening nut 20 several electrically conductive elements 17, which are designed, for example, as ring sections. The two ends of the electrically conductive element 17 designed as arcs 20*a*, 20*b* are in contact with the tube pipe 11 and the magnet body 12. The magnet body 12 is here contacted by the first arc 20*b* of the electrically conductive element 17 extending radial with reference to the solenoid 10, while the second arc 20*a* contacts the tube pipe 11 in axial direction. The connecting point 23 between the top end of the magnet body 12 and the tube pipe 11 inserted there additionally seals the seal 22*a* which is used in the fastening nut 20 for holding the electrically conductive element 17 and prevents here moisture or the like from intruding.

In order to protect the electrically conductive element 17 against corrosion the fastening nut 20 has additionally two other seals 22*b*, 22*c* which are assigned to the electrically conductive element 17 which are lowered in suitable receiving grooves 24 in the fastening nut 20. The seals 22*b*, 22*c* have here altogether the same length as the electrically conductive element 17 which is also arranged in the fastening nut 20. In order to create a clearly defined put-in position for the electrically conductive element 17 in the fastening screw 20 it has, along its circumference facing the magnet body 12, a shoulder 22 integrated in the fastening nut 20 which is in contact by the electrically conductive element 17 after finishing the putting-in or putting-on of the fastening nut 20 on the tube pipe 11.

Of course, there is also the possibility that no fastening nut is used for securing and improving, respectively, the connection between the magnet body 12 and the tube pipe 11. Instead of that the electrically conductive element 17 can also be designed as connecting means. The electrically conductive element 17 is then designed as clamp or shackle, or as washer or ring. In this embodiment, that means in the embodiment without fastening nut 20 or other means 14 for fastening, the electrically conductive element 17 is designed, for example, as ring with a projection for engaging in the tube pipe 11. The tube pipe 11, however, has in this case a circulating ring groove, a bead or other recess 30 or impression in which a projection can be put in, glued in, welded in or soldered in on the electrically conductive element 17. The electrically conductive element 17 thus fixed on the tube pipe 11 is bent after that in the direction of the magnet body 12 or deformed in another way, and thus comes in contact with the surface 19 of the magnet body 12. After a final pressing or jamming of the electrically conductive element 17 a permanent and loadable connection of tube pipe 11 and magnet body 12 is carried out. Besides, there is also the possibility of putting on the tube pipe 11 as means 14 for fastening magnet body 12 and tube pipe 11*a* circulating rubber seal with electrically conductive material which is then deformed.

This rubber seal has conductive particles, for example carbon particles. Of course, there is also the possibility that the rubber seal has only a conductive coating.

FIG. 2*a* shows a schematic cross section through another side view of a solenoid 10 according to the invention. This has also a tube pipe 11 on which a magnet body 12 has been put. The magnet body 12 is here fixed in press fit on the tube pipe 11. The means 14 for fastening the magnet body 12 to the tube pipe 11 is in the embodiment of FIG. 2*a* designed as cap 25 which is slid on the end of the tube pipe 11 projecting from the magnet body 12, and here also is fixed in press fit. As electrically conductive element 17 a ring 27 with double L-shaped profile is provided in the embodiment. This can be discerned particularly clearly in FIG. 2*b*. The ring 27 is integrated in the cap 25 and here attached to a shoulder 22 designed according to the profile form of the ring 27. While putting on the cap 25 on the end of the tube pipe 11 the ring 27 drags along the outer surface 18 of the tube pipe 11, and contacts here in axial direction the tube pipe 11. The second end of the ring 27 or the ring profile is, after the cap 25 has been completely put on the tube pipe 11, in contact with the surface 19 of the magnet body 12 facing the cap 25. A fixing and permanent securing of the cap 25 is done by inserting the ring 27 in a gap between the tube pipe 11 and the inner circumference surface of the cap 25 and clamps this thus towards the tube pipe 11. In order to prevent the ring 27 from falling out of the cap 25 here a seal ring 22*a* set in the inner profile of the ring 27 is provided here which braces the ring 27 with the cap 25. In order to secure here the contact space of ring 27, tube pipe 11 and magnet body 12 against intruding moisture, and therefore avoid corrosion which may impair the electric connection, in the cap 25 two additional recesses are provided in which other seals 22*c*, 22*b* are set in. These seal rings 22*b, c* are in contact, on the one hand, with the outer surface 18 of the tube pipe 11, and, on the other hand, with the surface 19 of the magnet body 12, and seal the contact space. In addition to the arrangement of an electrically conductive element 17 in the cap 25 there is the possibility here that the inner circumference surface of the cap 25, which is in contact, on the one hand, with the tube pipe 11, and, on the other hand, with the magnet body 12, is coated with an electrically conductive layer or coating. After putting on the cap 25 this coating contacts, on the one hand, the tube pipe 11 and, on the other hand, the magnet body 12, and thus improves also the electric connection between the parts.

In FIG. 2*b* the embodiment already described already in connection with FIG. 2*a* is shown in sections. The section indicated in FIG. 2*a* by a frame is shown here in an enlarged view. Here in particular the form and the profile of the ring as double L can be discerned. The cap 25, which is also shown in sections, has on its outer circumference surface additionally a non-slip coating 29 simplifying and improving putting the cap 25 on the tube pipe 11. Because of this non-slip coating 29 a particularly permanent connection between the cap 25 and the tube pipe, or a satisfying contacting of the cap 25 on the surface 19 of the magnet body 12 can be carried out as during the putting on of the cap 25 slipping or shifting of the tool is prevented by a non-slip or slip-resistant coating 29.

FIG. 3*a* shows a top view of an embodiment of the solenoid 10 according to the invention. Here it can also be discerned the tube pipe 11 which is arranged centrally in a magnet body 12. The magnet body 12 has been here slid on the tube pipe 11 during mounting and fixed on it in press fit. In order to secure a permanent connection between magnet body 12 and tube pipe 11, on the top surface 19 of the magnet body 12 a means 14 designed as clamp 32 is arranged for fastening which, on the one hand, is fixed, for example soldered on, welded on, glued on the magnet body 12, and, on the other hand, is put in the tube pipe 11 having a special recess 30 for it. The clamp shown detailed in FIG. 3*b* has, besides a projection 33, additionally a cutting edge 34 carrying out during mounting the solenoid 10 according to the invention a damage of the uppermost layer of the tube pipe 11, and effects or improves here an electric contact. The clamp 32 can be arranged already during manufacturing the magnet body 12 on it. However, there is also the possibility of a later arrangement. For that in the magnet body 12 or its surface 19 a recess or the like can be provided in which the clamp 32 is set in. During putting the magnet body 12 on the tube pipe 11 the clamp 32 is slightly deformed, and then locks with the projection or the cutting edge 34 arranged on it in a ring groove-like recess 30 in the tube pipe 11 which can be integrated later here or already during production of the tube pipe 11, and secures the magnet body 12 against slipping or sliding off the tube pipe 11. The clamp 32 is formed completely or partly of electrically conductive material. A radial contact of the magnet body 12 and a radial contact of the tube pipe 11 is effected via the clamp 32. Depending on the form of the clamp 32, if it has, for example, in axial direction of the tube pipe 11 other bent projections, also a radial contact of the tube pipe can be carried out.

In FIG. 4*a* another top view of a preferred embodiment of the solenoid 10 according to the invention is shown. This also has a tube pipe 11 connected with a magnet body 12. For securing the magnet body 12 on the tube pipe 11*a* snap ring 36 is provided as means 14 for fastening, which can be clearly seen in the cutout view of FIG. 4*b*, which is set in a ring groove-like recess 10 in the tube pipe 11. For mounting the solenoid 10 the snap ring 36 is bent up, slipped over the tube pipe 11 and released after that so that it snaps in the recess 30 in the tube pipe 11. The projections 37 provided on the snap ring 36 serve, on the one hand, for bending up the snap ring 36 or for attaching a suitable tool or pincers, on the other hand, these projections 37 reach also an improvement of the electric contact of magnet body 12 and tube pipe 11, as they are in contact in radial direction with the magnet body 12. The area of the snap ring 36 protruding from the recess 30, which can be seen in FIG. 4*b*, also reaches an electric connection of tube pipe 11 and magnet body 12, here an axial contact with the tube pipe 11 and a radial contact with the magnet body 12 being provided. The embodiments of the solenoid 10 presented in FIGS. 3*a*, 3*b*, 4*a* and 4*b* do not need additional means 14 for fastening, such as, for example, fastening nuts 20 or caps 25. Fixing or securing the magnet body 12 on the tube pipe 11 and the production of an electric connection between these magnetic components is realized only via the additional elements clamp 32, as it is shown in FIG. 3*a*, or snap ring 36, as it is shown in FIGS. 4*a*, 4*b*. The production of this embodiment of the solenoid 10 according to the invention thus proves itself as particularly economically as, on the one hand, only a few low-cost parts are used and, on the other hand, the costs for mounting are reduced considerably because of the easily set-in or attachable elements. Thus the connection is carried with costs as low as possible, however, presents a reliable and stable connection of magnet body 12 and tube pipe 11, and a permanent and durable, as within limits flexible and elastic, connection of the components tube pipe 11 and magnet body 12. Here also under stress a sufficient electric contact and thus grounding of these solenoids 10 is guaranteed.

FIG. 5 shows a perspective sectional view of an electrically conductive element 17 integrated in a seal 22*a*. This electrically conductive element 17 is designed here as ring 27 which has areas 28 extending, on the one hand, radial, and, on the other hand, axially to the tube pipe 11. The areas 28 extending radial to the tube pipe 11 contact in assembled condition of the solenoid 10 the tube pipe 11, while the areas 28 designed axially to the tube pipe 11 are in contact with the magnet body 12, and thus secure via the ring 27 an electric contact of these two structural parts of the solenoid 10. The ring 27 is received in the embodiment completely by a seal 22*a*. During manufacturing the electrically conductive element this is extrusion-coated or surrounded by foam by a sealing mass, for example a rubber mixture or another sealing material, and is almost completely integrated in the seal 22*a*. Only the areas 28 break through or protrude from the sealing body. Thus the embodiment of the electrically conductive element 17 presented in FIG. 5 reaches a sealing as large as possible of the element as the seal 22*a* has two seal beads 26*a, b* which can be put in, for example, suitable recesses or groove-like impressions in means 14 for fastening, and effect here an additional seal. The electrically conductive element is thus protected perfectly against corrosion, and nevertheless guarantees a satisfactory electric contact between tube pipe 11 and magnet body 12. A possible other embodiment of the electrically conductive element 17 presented in FIG. 5 provides that the electrically conductive element 17 is surrounded completely by sealing material, and only when the electrically conductive element 17 is set and clamped on the tube pipe 11 or the magnet body 12, breaks through the sealing mass by means of possibly sharp-edged projections 37, and after that contacts, on the one hand, the tube pipe 11, and, on the other hand, the magnet body 12.

Although the invention has been described by exact examples which are illustrated in the most extensive detail, it is pointed out here that this serves only for illustration, and that the invention is not necessarily limited to it because alternative embodiments and methods become clear for experts in view of the disclosure. Accordingly changed can be considered which can be made without departing from the contents of the described invention.

The invention claimed is:

1. A solenoid with a tube pipe as guide for a magnet armature, and a magnet body, wherein the magnet body is connected with the tube pipe, characterized in that at least one means for fastening the magnet body to the tube pipe is provided, and the means has at least one electrically conductive element contacting, on the one hand, the tube pipe and, on the other hand, the magnet body for the electric connection of tube pipe and magnet body; and characterized in that the electrically conductive element is a partial ring enclosing the tube pipe in several areas, and the ring has a cross-sectional arc shape which causes a certain pre-tension of the electrically conductive element with reference to the magnet body.

2. The solenoid according to claim 1, characterized in that the means for fastening can be a nut clamp, a split-in, a shackle, a plug-type connector, a clip, a clamping ring, or a sealing element, and be put on or in, screwed on or clamped on the tube pipe or the magnet body or can be jammed with them, wherein the means for fastening is the electrically conductive element, or the electrically conductive element is connected fixedly or releasably with the means or integrated in it.

3. The solenoid according to claim 1, characterized in that the electrically conductive element is releasably or fixedly glued on, melted on, soldered on, welded on, jammed in or put in the means for fastening or the tube pipe or the magnet body.

4. The solenoid according to claim 1, characterized in that the electrically conductive element is integrated with the means for fastening, the magnet body or the tube pipe.

5. The solenoid according to claim 1, characterized in that the electrically conductive element is designed deformable or twisting, and a contact of magnet body and tube pipe can be produced after deforming or twisting the electrically conductive element, wherein an engagement of the electrically conductive element in the magnet body and/or the tube pipe is provided before, during or after deforming or twisting.

6. A solenoid according to claim 1, characterized in that a seal is provided enclosing the electrically conductive element, or the electrically conductive element is arranged between at least two seals arranged in axial direction of the tube pipe, or wherein the electrically conductive element is integrated or injected in the seal, and breaks through or penetrates the seal during deforming or twisting in radial or axial direction, and contacts the tube pipe and the magnet body.

7. The solenoid according to claim 1, characterized in that on the means for fastening seals are provided, wherein the electrically conductive element is arranged between the seals, and a first seal is in contact axial with the tube pipe and a second seal radial with the magnet body.

8. The solenoid according to claim 1, characterized in that a seal enclosing the electrically conductive element is provided, on the means for fastening seals are provided, and the seals is/are designed as O-ring, seal tape or sealing lip, and at least two seals limit a contact space in which the electrically conductive element is arranged toward two sides.

9. The solenoid according to claim 1, characterized in that an additional seal arranged directly on or in the electrically conductive element is provided, in particular wherein the seal connects or braces the electrically conductive element with the means for fastening.

10. The solenoid according to claim 1, characterized in that the electrically conductive element is a ground strap, wherein a first end of the ground strap contacts the tube pipe and a second end of the ground strap contacts the magnet body, and the strap body is arranged in or on the means for fastening.

11. The solenoid according to claim 1, characterized in that the electrically conductive element is at least partly electrically conductive coating of the means for fastening, wherein the coating contacts the tube pipe and the magnet body only after the means for fastening has been suitably loaded with current.

12. The solenoid according to claim 1, characterized in that a housing is provided encircling the tube pipe and the magnet body, and an electric connection between the housing, the tube pipe and/or the magnet body can be produced via the electrically conductive element.

13. The solenoid according to claim 1, characterized in that the means for fastening is formed of an electrically non-conductive basic material which is charged with conductive material, wherein in particular the electrically non-conductive material contains metal particles or chips, graphite dust or carbon dust as additive or coating.

* * * * *